US007644498B2

(12) United States Patent
Haehnle et al.

(10) Patent No.: US 7,644,498 B2
(45) Date of Patent: Jan. 12, 2010

(54) METHOD OF MODIFYING THE COUPLING GEOMETRY IN SHROUD BAND SEGMENTS OF TURBINE MOVING BLADES

(75) Inventors: Hartmut Haehnle, Kuessaberg (DE); Christoph Nagler, Zurich (CH); Ingo Schwarz, Tarragona (ES)

(73) Assignee: Alstom Technology, Ltd, Baden (CH)

( * ) Notice: Subject to any disclaimer, the term of this patent is extended or adjusted under 35 U.S.C. 154(b) by 443 days.

(21) Appl. No.: 10/873,880

(22) Filed: Jun. 22, 2004

(65) Prior Publication Data

US 2005/0097741 A1 May 12, 2005

(30) Foreign Application Priority Data

Jun. 23, 2003 (DE) ..... 103 28 310

(51) Int. Cl.
*B23P 6/00* (2006.01)

(52) U.S. Cl. ..... 29/889.1; 29/889

(58) Field of Classification Search ..... 29/889.1, 29/889

See application file for complete search history.

(56) References Cited

U.S. PATENT DOCUMENTS

| | | | | |
|---|---|---|---|---|
| 4,291,448 | A * | 9/1981 | Cretella et al. | 29/889.1 |
| 4,400,915 | A | 8/1983 | Arrigoni | |
| 4,589,175 | A | 5/1986 | Arrigoni | |
| 4,657,171 | A | 4/1987 | Robins | |
| 4,699,569 | A | 10/1987 | Gloor | 418/191 |
| 4,893,388 | A | 1/1990 | Amos et al. | |
| 5,330,326 | A * | 7/1994 | Kuehne et al. | 416/248 |
| 5,511,948 | A | 4/1996 | Suzuki et al. | 416/191 |
| 6,464,128 | B1 | 10/2002 | Messelling et al. | 228/119 |
| 6,609,300 | B2 * | 8/2003 | Burgess | 29/889.4 |
| 6,701,616 | B2 * | 3/2004 | Smith et al. | 29/889.1 |

FOREIGN PATENT DOCUMENTS

| | | |
|---|---|---|
| DE | 3517283 | 11/1986 |
| DE | 3620162 | 1/1987 |
| EP | 0389913 | 10/1990 |

* cited by examiner

*Primary Examiner*—Rick K Chang
(74) *Attorney, Agent, or Firm*—Darby & Darby

(57) ABSTRACT

A method of modifying a coupling geometry in a shroud band segment of a turbine moving blade includes the following steps: calculation of a modified coupling geometry; removal of shroud band material situated outside the modified coupling geometry; and/or application of additional material not present inside the modified coupling geometry; reworking the removal and/or application zones. The method avoids disadvantages of the prior art and provides improved wear behavior in the coupling region so as to prolong the life of the turbine blades in an effective and inexpensive manner.

7 Claims, 4 Drawing Sheets

METHOD OF MODIFYING THE COUPLING GEOMETRY IN SHROUD BAND SEGMENTS OF TURBINE MOVING BLADES

Priority is claimed to German Patent Application No. 103 28 310.2, filed on Jun. 23, 2003, the entire disclosure of which is incorporated by reference herein.

The present invention relates to a method of modifying a coupling geometry in a shroud band segment of a turbine moving blade.

BACKGROUND

In turbine stages, it is known to provide turbine moving blades with a shroud band. In this case, the shroud band coupling of the blades or blade segments lying next to one another is characterized by a defined coupling angle, which, however, is affected by centrifugal forces acting on the blades, by the blade untwisting, by the shroud band stretching, by the temperature of the working medium, etc. The stresses which act during the mutual support of the blades during operation can in turn be controlled by the coupling angle and the coupling area. Such turbine moving blades having a shroud band segment are described, for example, in German patent DE 36 20 162 C2, related to U.S. Pat. No. 4,699,569 and German Patent DE 35 17 283 C2, all of which are incorporated by reference herein.

The type of coupling, i.e. the coupling angle and the coupling area, is of considerable importance for the operating behavior of the turbine moving blades, and here in particular for the wear behavior in the region of the coupling, on account of the transmission of the coupling forces. On account of the abovementioned factors which affect the shroud band coupling, even small changes to the turbine design of individual turbine stages, for example by conversion of a turbine stage or through changed operating conditions, may lead to undesirably high wear on existing turbine stages. If it is found on the basis of operating experience that the wear in the coupling region of two turbine shroud band segments is inadmissibly high, the procedure hitherto has simply been to repair the turbine blade in the coupling region. In the process, the coupling region is as a rule coated with chromium carbide. In the extreme case, individual blades or blade groups have to be exchanged. In addition, the maintenance intervals are shortened in the most unfavorable cases, which reduces the efficiency of the plant.

SUMMARY OF THE INVENTION

An object of the present Invention is to provide a method of modifying the coupling angle in shroud band segments of turbine moving blades, which method improves the wear behavior in the coupling region and/or prolongs the life of the shroud band segments of turbine moving blades in an effective and inexpensive manner. In this case, the modification is to be capable of being carried out either on existing turbine moving blades or else on new parts which can be exchanged for turbine moving blades which have reached the end of their life.

The method according to the present invention for modifying the coupling geometry in shroud band segments of turbine moving blades has the following steps: calculation of a modified coupling geometry. Here, for example, simulations are used in which the changed flow conditions in a modernized turbomachine and their effects on the relevant turbine stage can be analyzed. Removal of shroud band material situated outside the modified coupling geometry; and/or application of additional material not present inside the modified coupling geometry; reworking the removal and/or application zones. Rework may be necessary in particular after material application, since the desired surface quality can be achieved as a result. In this way, for example, the coupling angle and the coupling area, or else only the coupling angle or only the coupling area, can be varied.

The disadvantages of the prior art are avoided and the wear behavior in the coupling region is improved by the method according to the present invention. Furthermore, the life of the turbine blades is prolonged in an effective and inexpensive manner.

An advantageous development of the method according to the present invention provides for the application zones to be machined beforehand in such a way that an improved application cross section is made available. This is done, for example, by material removal at a location of the shroud band segment which offers a sufficiently large cross section in order thus to securely and reliably connect applied material. In addition, angle cross sections which are advantageous from the production point of view can also be defined in this way, since the applied material is connected on several sides to the original shroud band segment.

An advantageous embodiment of the method according to the present invention furthermore provides for the modified coupling geometry to provide a change in the coupling angle of at least ±5°, preferably ±15° to ±40°. In this case, the angle specifications are measured from the circumferential direction. It is essential to aim for an increase in the coupling angle in the case of transmitted coupling forces which are too small. Conversely, a reduction in the coupling angle is aimed for in the case of transmission forces which are too high.

Furthermore, an especially advantageous development of the method provides for the change in the coupling angle to be ±25°. This angle, for example in tests, has proved to be advantageous for changing coupling angles from 15° to 40°.

Another advantageous embodiment of the method according to the present invention provides for the application of additional material to be effected by means of deposition welding. Here, for example, deposition welding by means of laser has proved successful.

Another advantageous embodiment of the method according to the present invention provides for the removal of excess material to be effected by means of grinding. Provided larger segments are to be cut off, a cut-off grinder, for example, can be used here.

A further method according to the present invention for modifying an existing casting mold for a turbine moving blade having a shroud band segment, for a changed geometry of the coupling angle, has the following steps: calculation of a modified coupling geometry; removal of casting mold material situated inside the modified coupling geometry; and/or application of additional casting mold material, which is not present, outside the modified coupling geometry; reworking the removal and/or application zones. This modification essentially involves the opposite steps from those in the method according to the present invention with regard to modifying the shroud band itself, since a negative mold is involved here. Such a modification of already existing casting molds is helpful if replacement turbine blades are to be produced which otherwise would have to be modified subsequently. In this way, an inexpensive possibility for the further use of already existing casting molds is presented without having to forgo the advantages of the modified coupling geometry.

An advantageous embodiment of the method according to the present invention provides for the modified coupling geometry to have a change in the coupling angle of at least ±5°, preferably ±15° to ±40°. It is especially advantageous if the change in the coupling angle is ±25°.

In this case, too, the application of additional material can be advantageously effected by means of deposition welding and the removal of excess material can be advantageously effected by means of grinding.

BRIEF DESCRIPTION OF THE DRAWINGS

An advantageous embodiment of the present invention is described below in conjunction with the attached drawings, in which.

Only the elements essential for the understanding of the present invention are shown. The same or similar parts are identified with the same designations in the following description.

DETAILED DESCRIPTION

Figure 1:
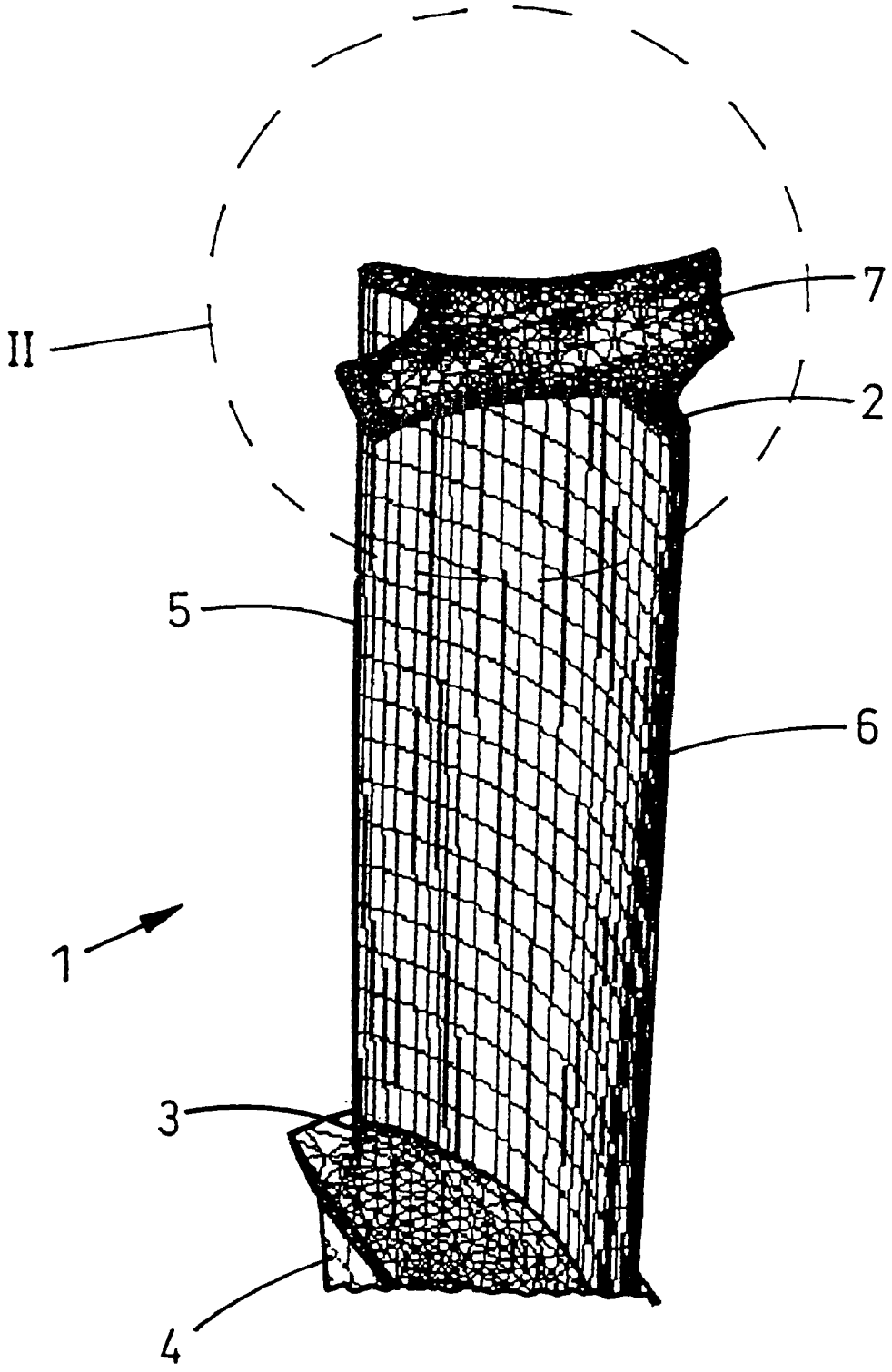
FIG. 1 shows a perspective view of a turbine moving blade with shroud band segment.

FIG. 1 shows a perspective view of a lattice model of a turbine moving blade 1 having a shroud band segment 7. The turbine moving blade 1 has a blade tip 2 at its top end and a blade root 3 at its bottom end, the blade root 3 continuing in a shank 4 (shown only approximately). The airfoil leading edge 5 is shown on the left-hand side of the drawing and the airfoil trailing edge 6 is shown on the right-hand side of the drawing.

Figure 2:
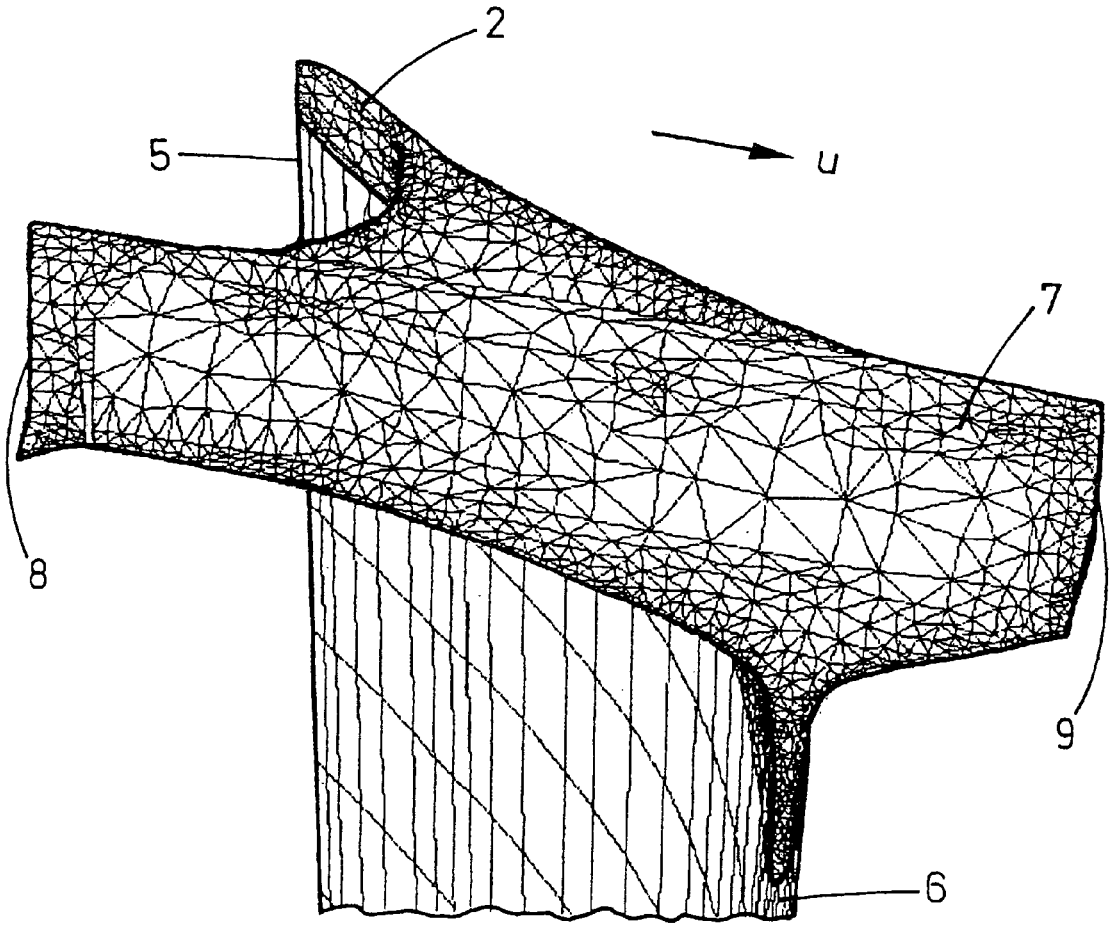
FIG. 2 shows a schematic detail view II of the shroud band segment from FIG. 1.

As can be seen in particular in FIG. 2 of the illustration of the detail II from FIG. 1, the shroud band segment 7 on the blade tip 2 runs essentially transversely to the airfoil chord running between the airfoil leading edge 5 and the airfoil trailing edge 6 and parallel to the circumferential direction U. In this case, the shroud band segment 7 does not extend over the entire blade depth but only to a region in the blade center. The transition between the shroud band segment 7 and the blade tip 2 is determined by transition radii. Furthermore, contact surfaces 8, 9 are provided on the side faces of the shroud band segment 7, these contact surfaces 8, 9 bearing against contact surfaces of adjacent shroud band segments during operation.

Figure 3B:
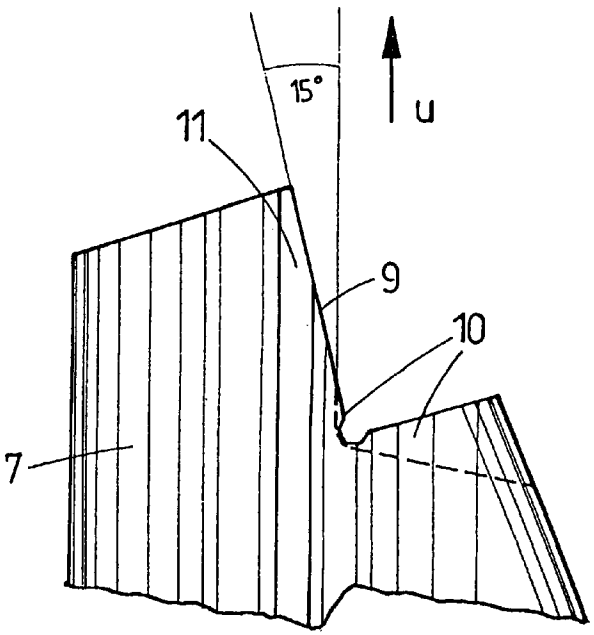
FIGS. 3*a*, 3*b* show a schematic plan view of the coupling region of the shroud band segment from the pressure and suction sides without modification.
Figure 3A:
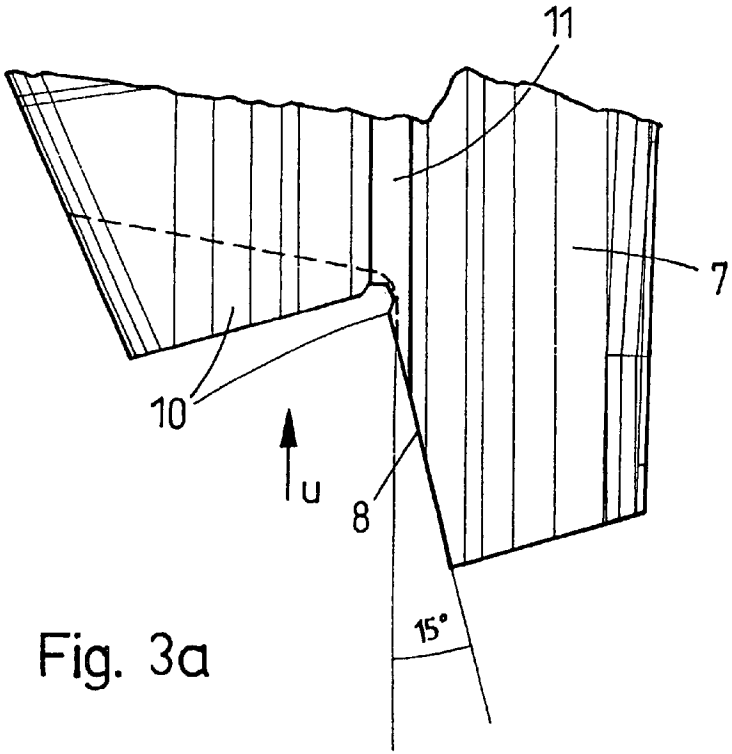

FIGS. 3*a* and 3*b* show a schematic plan view of the coupling region of shroud band segments 7 from the pressure side and suction side without modification.

The pressure-side end, shown in FIG. 3*a*, of the shroud band segment 7 exhibits a fin 11 which is arranged approximately centrally and serves as a sealing web between the casing inner wall of the turbine casing and the turbine shroud band composed of the shroud band segments 7. In this case, in the present exemplary embodiment, before the modification, the contact surface 8 of the shroud band segment 7, this contact surface 8 serving for the mutual support of adjacent turbine moving blades, has an initial angle of 15° measured from the circumferential direction. Furthermore, the stepped or Z-shaped side margin of the shroud band segment without modification can be clearly seen.

The suction-side end, shown in FIG. 3*b*, of the shroud band segment 7 likewise exhibits a fin 11 arranged approximately centrally. The contact surface 9, which virtually forms the long connecting line between the top and the bottom horizontal Z beams, also has on the suction-side shroud band segment 7 an initial angle of 15°, measured from the circumferential direction.

The optimum angle calculated in the present exemplary embodiment for the modified pressure-side and suction-side contact surfaces is in each case 40° measured from the circumferential direction. The desired change in angle is therefore 25° in each case. To change the coupling geometry, material has to be removed at a few locations and added at other locations.

To apply additional material, the corresponding shroud band sections are prepared in such a way that an optimum cross section for applying new shroud band material is provided by previous material removal. These preparation areas are defined in FIGS. 3*a* and 3*b* by broken lines and the outer contour and are identified by reference numeral 10. In this case, in the present exemplary embodiment, the material removal is effected by a grinding process. In principle, however, any other suitable removal process is possible.

Figure 4B:
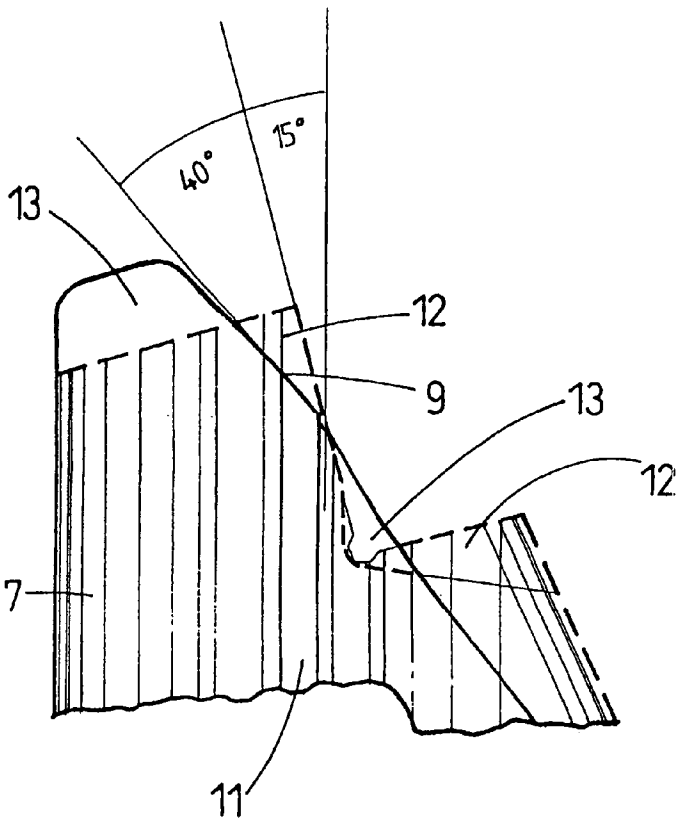
FIGS. 4*a*, 4*b* show a schematic plan view of the coupling region of the shroud band segment from the pressure and suction sides with modification.
Figure 4A:
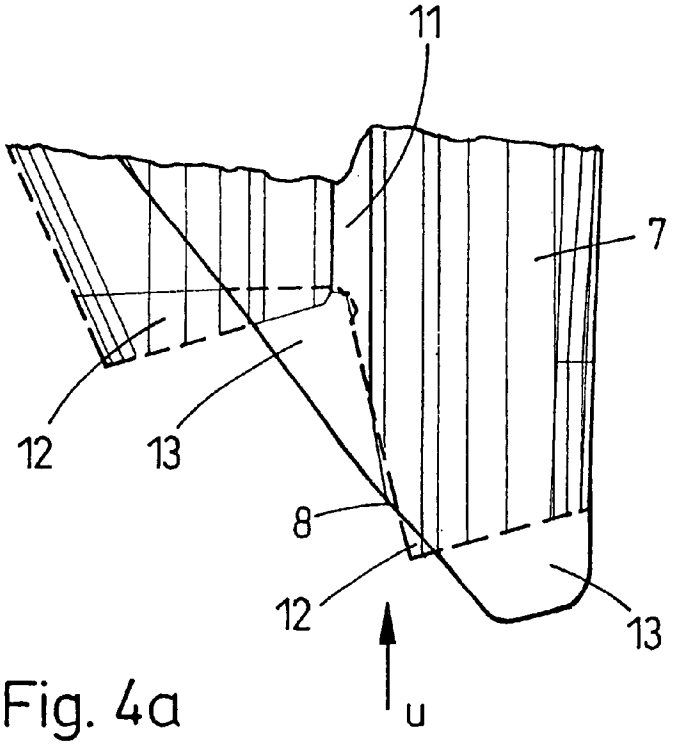

FIGS. 4*a* and 4*b* show a schematic plan view of the coupling region of the shroud band segments 7 from the pressure and suction sides with modified coupling geometry. Also shown here are the fins 11, which run parallel to the circumferential direction shown by arrow U. In this case, the contact surfaces 8, 9 run at a modified angle of 40°, measured from the circumferential direction.

In FIGS. 4*a* and 4*b*, the application areas 13 in which additional shroud band material has been applied are shown by broken lines inside the shroud band contour. The removal areas 12, i.e. zones in which excess shroud band material has been removed, are defined by broken lines outside the shroud band contour. The change in angle from 15° to 40° caused by the material removal and the material application is clearly illustrated in FIG. 4*b*.

Furthermore, the change in the contour from an originally Z-shaped contour into an essentially diagonally running coupling region having a rounded-off end region can be seen in FIGS. 4*a* and 4*b*. As a result, the wear properties are improved and the life of the shroud band segment is considerably prolonged.

In the present exemplary embodiment, the material removal is effected by means of cut-off grinding and the material application is effected by means of deposition welding, here by a TIG welding process. In principle, however, any suitable application and removal process can be used.

What is claimed is:

1. A method of modifying a shroud band segment of a turbine moving blade, the shroud band segment having an initial coupling geometry for coupling with a further shroud band segment adjacent to the shroud band segment, the coupling geometry having an initial coupling angle of the shroud band segment relative to a circumferential direction of the turbine, the method comprising:

calculating a modified coupling geometry for the shroud band segment, the modified geometry including a modified coupling angle of the shroud band segment relative to the circumferential direction;

creating at least one of a removal zone and an application zone, wherein the creating of the removal zone includes removing a first amount of shroud band material from a side face of the shroud band segment situated outside the modified coupling geometry and wherein the creating of the application zone includes applying a second amount of an additional material to the side face of the shroud band segment within the modified coupling geometry; and reworking at least one of the removal and application zones, wherein the creating of the at least one of the removal zone and the application zone and the reworking results in the shroud band segment having the modified coupling angle, wherein the difference between the initial coupling angle and the modified coupling angle is at least ±5°.

2. The method as recited in claim 1 further comprising premachining the application zone so as to make available an improved application cross section.

3. The method as recited in claim 1, wherein the difference between the initial coupling angle and the modified coupling angle is ±15° to ±40°.

4. The method as recited in claim 1, wherein the difference between the initial coupling angle and the modified coupling angle is about ±25°.

5. The method as recited in claim 1, wherein the applying is performed using deposition welding.

6. The method as recited in claim 1, wherein the removing is performed using grinding.

7. The method as recited in claim 1, wherein the creating step includes creating the application zone at a location other than the removal zone.

* * * * *